US006748866B2

(12) United States Patent
Moll

(10) Patent No.: US 6,748,866 B2
(45) Date of Patent: Jun. 15, 2004

(54) METHOD FOR POSITIONING A MALE MOULD ON A COUNTER-PRESSURE CYLINDER OF AN EMBOSSING STATION

(75) Inventor: Herbert Moll, Dürnau (DE)

(73) Assignee: Hinderer & Muhlich KG, Goppingen (DE)

( * ) Notice: Subject to any disclaimer, the term of this patent is extended or adjusted under 35 U.S.C. 154(b) by 0 days.

(21) Appl. No.: 10/362,384

(22) PCT Filed: Aug. 4, 2001

(86) PCT No.: PCT/DE01/03010

§ 371 (c)(1),
(2), (4) Date: May 9, 2003

(87) PCT Pub. No.: WO02/16121

PCT Pub. Date: Feb. 28, 2002

(65) Prior Publication Data

US 2004/0035311 A1 Feb. 26, 2004

(30) Foreign Application Priority Data

Aug. 19, 2000 (DE) ..... 100 40 683

(51) Int. Cl.[7] ..... B41L 3/02

(52) U.S. Cl. ..... 101/486; 101/DIG. 36; 101/32

(58) Field of Search ..... 101/483, 486, 101/485, 481, DIG. 36, 32, 23

(56) References Cited

U.S. PATENT DOCUMENTS

| | | | | | |
|---|---|---|---|---|---|
| 3,668,030 | A | | 6/1972 | Broderick | |
| 3,921,524 | A | * | 11/1975 | Ritchie | 101/375 |
| 4,059,000 | A | * | 11/1977 | Bodnar | 72/197 |
| 4,878,407 | A | * | 11/1989 | Harrison et al. | 101/216 |
| 5,182,063 | A | * | 1/1993 | Lang | 101/32 |
| 5,505,125 | A | | 4/1996 | Kapolnek | |
| 5,782,156 | A | * | 7/1998 | Collins | 101/415.1 |
| 6,062,134 | A | * | 5/2000 | Eitel et al. | 101/28 |
| 6,227,572 | B1 | * | 5/2001 | Lyen | 283/58 |
| 6,387,201 | B1 | * | 5/2002 | Stuart et al. | 101/23 |

FOREIGN PATENT DOCUMENTS

GB 1598183 9/1981

* cited by examiner

*Primary Examiner*—Eugene H. Eickholt
(74) *Attorney, Agent, or Firm*—Hoffmann & Baron, LLP

(57) ABSTRACT

Describe is a method of positioning a male die member (34) on a backing rolled (14) of a stamping station (10), which backing roller co-operates with a stamping roller (12), wherein the stamping roller (12) has a die (18). Temporarily fixed to the die (18) of the stamping roller (12) is a flexible transfer male die member (24) having a fitting window (32). The transfer male member (24) is transferred from the stamping roller (12) to the backing roller (14) and fixed to the backing roller (14). The male die member (34) is then fixed in accurately fitting relationship in the fitting window (32) of the transfer male die member (24).

6 Claims, 2 Drawing Sheets

METHOD FOR POSITIONING A MALE MOULD ON A COUNTER-PRESSURE CYLINDER OF AN EMBOSSING STATION

FIELD OF THE INVENTION

The invention concerns a method of precisely positioning a male die member on a backing roller of a stamping station, which backing roller co-operates with a stamping roller, wherein at its cylindrical peripheral surface the stamping roller has a die with a die relief structuring and the male die member which is provided with a male die member relief structuring negatively corresponding to the die relief structuring is positioned on the cylindrical peripheral surface of the backing roller in accurate fitting relationship with the die on the cylindrical peripheral surface of the stamping roller.

BACKGROUND OF THE INVENTION

Such a known method involves using a male die member comprising a thin, flexible, that is to say bendable and curvable material, in order to be able to temporarily mount the male die member to the die provided on the cylindrical peripheral surface of the stamping roller. Then, during a simultaneous rotary movement of the stamping roller and the backing roller, the male die member which Is temporarily fixed to the die on the stamping roller is transferred from the stamping roller to the backing roller and fixed on the cylindrical peripheral surface of the backing roller. During that transfer the male die member is curved from the direction of curvature of the stamping roller into the oppositely directed direction of curvature of the backing roller, and for that reason the male die member therefore has to be suitably flexible, that is to say bendable or curvable.

The stamping station which is assembled in that way, with the die on the stamping roller and the male die member on the backing roller, is then available for carrying out relief stamping operations in order for example to structure paper with a relief and at the same time to apply a stamping foil thereto by a stamping or embossing operation. In order to carry out such a relief stamping operation however it is necessary that not only the die on the stamping roller but also the male die member on the backing roller are suitably hard and stable in relation to pressure. That requirement in terms of hardness and stability in respect of pressure is in conflict with the requirement for flexibility and workability of the male die member, this therefore resulting in corresponding limitations.

SUMMARY OF THE INVENTION

The object of the present invention is to provide a method of the kind set forth in the opening part of this specification, in which the contradiction between stability in respect of pressure and hardness of the male die member with the requirement for flexibility and curvability thereof is eliminated in a simple fashion.

In accordance with the invention in a method of the kind set forth in the opening part of this specification that object is attained in that a thin flexible bendable transfer male die member having a fitting window is temporarily fixed in accurately positioned relationship to the die of the stamping roller, that the transfer male die member is transferred from the stamping roller to the backing roller and fixed to the backing roller, wherein the stamping roller and the backing roller are driven in rotation in mutually opposite relationship at mutually corresponding peripheral speeds, and that then the male die member is fixed in accurate fitting relationship in the fitting window of the transfer male die member fixed to the backing roller, wherein the male die member provided with the male die member relief structuring comprises a thin material which is stable in respect of shape and which has a cylindrical curvature corresponding to the curvature of the cylindrical peripheral surface of the backing roller.

The method according to the invention involves using a thin, flexible, bendable transfer male die member and a male die member which is stable in respect of shape. The transfer male die member only serves to establish on the backing roller the position for the male die member which is stable in respect of shape, said position corresponding in accurately fitting relationship to the die of the stamping roller. The transfer male die member can therefore advantageously comprise a flexible, bendable material. The male die member which is prefabricated with the male die member relief structuring advantageously comprises a material which is stable in respect of shape. In accordance with the invention the above-mentioned conflict between flexibility and bendability or curvability and stability in respect of pressure and hardness of known male die members is advantageously eliminated.

The method according to the invention preferably uses a transfer male die member which has a synthetic resin layer on a woven base cloth, wherein the synthetic resin layer on the base cloth forms a frame which definedly delimits the fitting window for the male die member of material which is stable in respect of shape. It is preferred in that respect if the synthetic resin layer is of a thickness which corresponds to the thickness of the male die member. Such a configuration provides that the male die member with the relief structuring thereon and the synthetic resin layer forming a frame around the male die member blend into each other smoothly and continuously and without a step, which has a positive effect on the stamping properties of the stamping station.

The method according to the invention can use a transfer male die member, wherein the base cloth is a glass fiber cloth and the synthetic resin layer is an epoxy resin layer. Transfer male die members of that kind have an optimum service life.

It is advantageous if the transfer male die member is glued fast with its base cloth to the cylindrical peripheral surface of the backing roller. For that purpose the transfer male die member and/or the cylindrical peripheral surface of the backing roller can be provided with a suitable adhesive. Likewise it is desirable if the prefabricated male die member which involves a cylindrical curvature corresponding to the curvature of the cylindrical peripheral surface of the backing roller and which comprises material that is stable in respect of shape and for example involves brass or the like is glued fast in the fitting window of the transfer male die member.

The method according to the invention results in a stamping station for relief structuring and stamping of suitable sheet or web material such as paper or the like, wherein the stamping station, with an excellent service life, permits precise operation, that is to say structuring and stamping. Further details, features and advantages will be apparent from the description hereinafter of an embodiment of the method according to the invention and essential method steps thereof, which is shown in highly diagrammatic form in the drawing in which:

DETAILED DESCRIPTION OF THE PREFERRED EMBODIMENTS

Figure 1A:
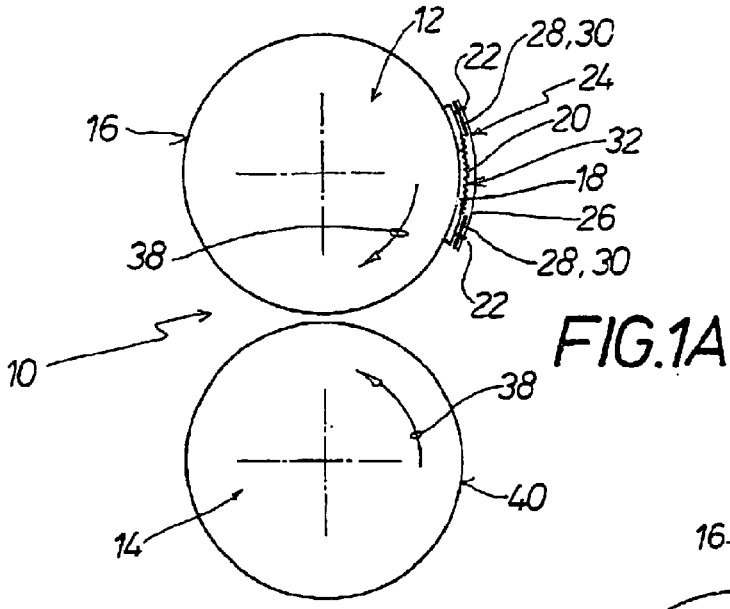
FIG. 1A shows a first method step of the method according to the invention.

FIG. 1A diagrammatically shows a stamping station 10 with a stamping roller 12 and a counter-pressure or backing roller 14. Provided at the cylindrical peripheral surface 16 of the stamping roller 12 is a die 18 provided with a die relief structuring 20. It will be appreciated that more than one die 18 can be provided on the cylindrical peripheral surface 16 of the stamping roller 12.

Figure 2:
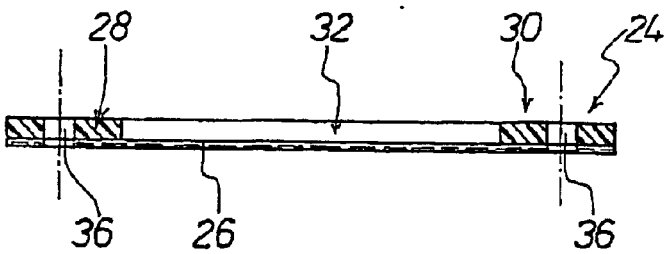
FIG. 2 shows a sectional view of a transfer male die member on an enlarged scale, which is not true to scale.

Temporarily mounted to the die 18 are fixing element 22 as are known for example from the present applicants' DE 195 41 170 C2. A transfer male die member 24 which is shown in longitudinal section and not true to scale in FIG. 2 is temporarily fixed on the die 18 by means of the fixing elements 22. The transfer male die member 24 has a woven base cloth 26 and on the base cloth a synthetic resin layer 28 which forms a frame 30 extending therearound. The frame 30 delimits and establishes a fitting window 32 for a male die member 34 comprising a material that is stable in respect of shape (see FIG. 3).

The transfer male die member 24 is provided with through holes 36 (see FIG. 2) for the fixing elements 22.

The transfer male die member 24 is mounted on the die 18 of the stamping roller 12 in such a way that the synthetic resin layer 28 in the form of the frame 30 faces towards the die 18. The fitting window 32 can be filled with a filling material such as paper.

Figure 1B:
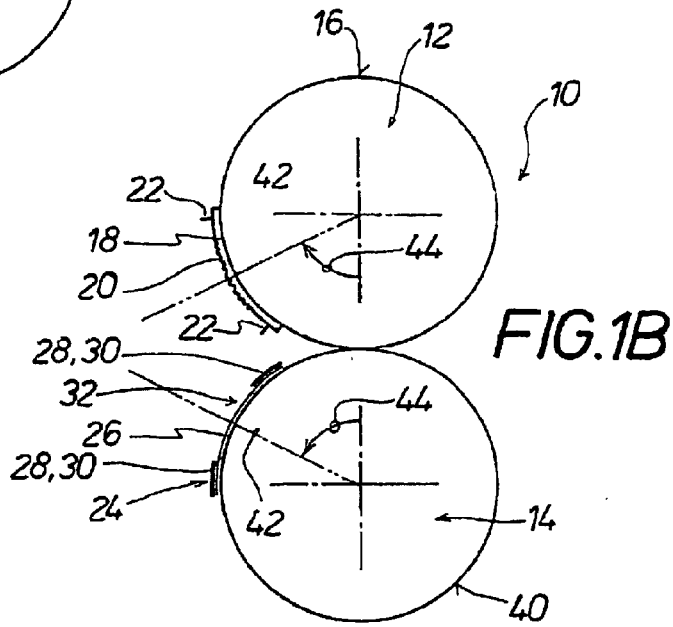
FIG. 1B shows a second method step following the first method step of FIG. 1A.
Figure 1C:
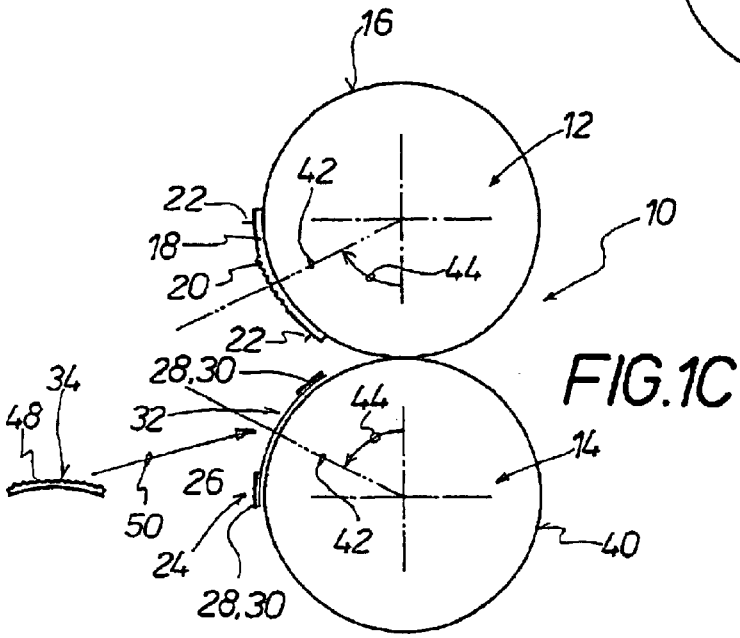
FIG. 1C shows a third method step following the method step of FIG. 1B.

After the transfer male die member 24 has been mounted to the die 18 the stamping roller 18 and the backing roller 14 of the stamping station 10 are driven in rotation in mutually opposite relationship at mutually corresponding peripheral speeds. That is indicated in FIG. 1A by the two arcuate arrows 38. As a consequence of that simultaneous rotation the transfer male die member 24 is transferred from the stamping roller 12 to the backing roller 14. This is illustrated in FIG. 1C. The transfer male die member 24 is fixed to the cylindrical surface 40 of the backing roller 14 in precisely correctly positioned relationship with respect to the die 18 of the stamping roller 12. This is indicated in FIG. 1B and FIG. 1C by the double dot-dashed lines 42 and the associated peripheral angles indicated by the arcuate arrows 44.

Figure 3:
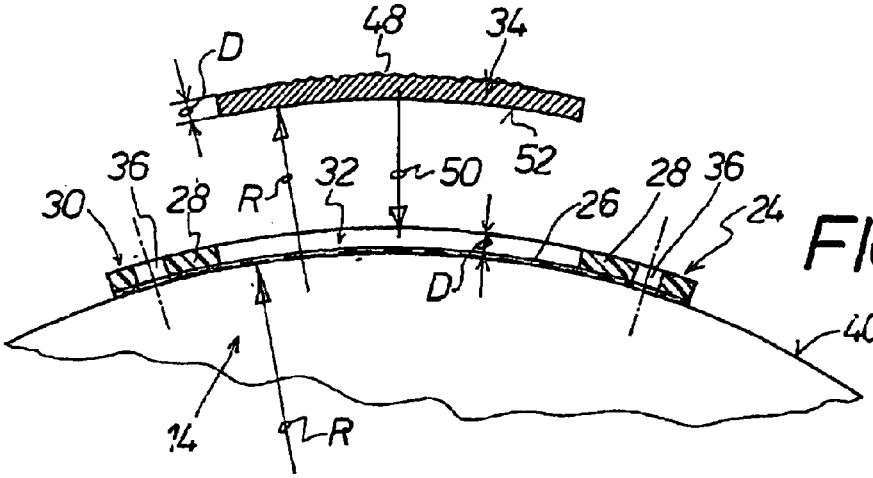
FIG. 3 shows the transfer male die member of FIG. 2 in the condition of being fixed to the backing roller, jointly with the prefabricated male die member of material that is stable in respect of shape, shown at a spacing from the transfer male die member.

Fixing of the thin, flexible and bendable transfer male die member 24 to the cylindrical surface of the backing roller 14 is effected for example by adhesive. After the operation of fixing the transfer male die member 24 the backing roller 14 is stopped. Thereafter—after removal of the filling material—a prefabricated male die member 46 comprising a thin material which is stable in respect of shape (see FIG. 1C) is fixed in accurately positioned relationship in the fitting window 32 of the transfer male die member 24. Fixing of the male die member 46 in the fitting window 32 of the transfer male die member 24 may also be implemented by adhesive. Insertion of the prefabricated male die member 46 which is provided with a male die member relief structuring 48, into the fitting window 32 of the transfer male die member 24 fixed to the cylindrical peripheral surface 40 of the backing roller 14, is indicated by the arrow 50 in FIG. 1C and in FIG. 3. The relief structuring 48 on the male die member 34 is negatively adapted to the relief structuring 20 of the die 18 of the stamping roller 12. If the die relief structuring 20 forms a positive configuration, then the male die member relief structuring 48 forms the corresponding negative configuration, and vice-versa. The backing roller 14 is shown in regard to a portion thereof, in FIG. 3. FIG. 3 also shows that the male die member 34 which is stable in respect of shape has an internal surface 52 which is concavely curved in a part-cylindrical configuration and the curvature R of which precisely corresponds to the curvature R of the cylindrical peripheral surface 40 of the backing roller 14. In addition the male die member 34 which is stable in respect of shape is of a wall thickness D which precisely corresponds to the wall thickness D of the synthetic resin layer 28 of the transfer male die member 24.

Figure 4:
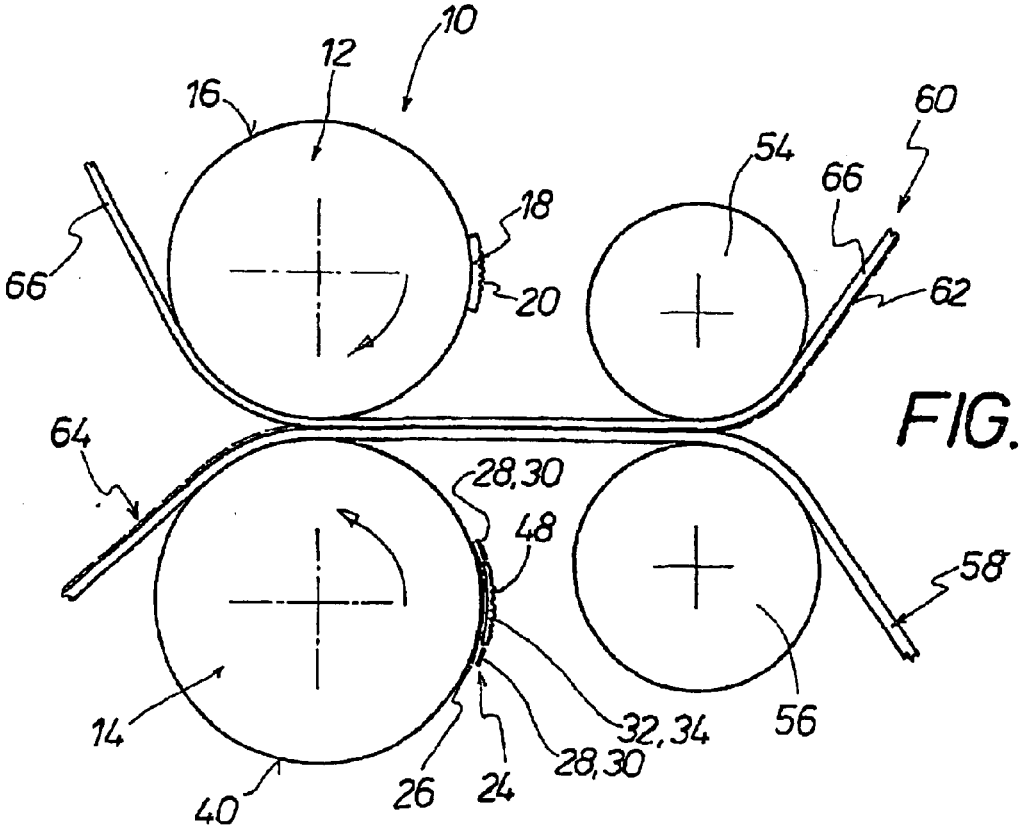
FIG. 4 shows the stamping station produced according to the invention during operation thereof for structuring a web or sheet material and applying a stamping foil thereto by an embossing procedure.

The male die member 30 which is stable in respect of shape is accurately fitted into the fitting window 32 of the transfer male die member 24 and fixed in the window 32 by adhesive. The stamping station 10 which is prepared or assembled in that way is then available for the structuring and stamping procedure, as can be seen from FIG. 4. Provided laterally beside the desirably heatable stamping roller 12 of the stamping station 10 is a guide roller 54 while provided laterally beside the backing roller 14 is a second guide roller 56. A web of paper 58 for example is fed to the stamping station 10 around the guide roller 56 and a stamping foil web 60 is fed to the stamping station 10 around the guide roller 54. The stamping roller 12 and the backing roller 14 of the stamping station 10 are driven in rotation. In that situation the web of paper 58 and the stamping foil web 60 are moved simultaneously through the stamping station 10. When that happens the paper web 58 is structured by the die 18 and the male die member 34 and at the same time the decorative layer 62 of the stamping foil 60, which faces towards the paper web 58, is stamped on to the paper web 68. The structured paper web 58 with the decorative layer 62 applied thereto by the stamping or embossing operation is identified by reference numeral 64 in FIG. 4 downstream of the stamping roller 12. The carrier of the stamping foil 60, which is detached from the stamping foil 60 downstream of the stamping station, is Identified by reference numeral 66.

The same details are respectively identified in FIGS. 1 through 4 by the same references so that there is no need for all features to be respectively described in detail in relation to each of the Figures.

What is claimed is:

1. A method of precisely positioning a male die member (34) on a backing roller (14) of a stamping station (10), which backing roller co-operates with a stamping roller (12), wherein at its cylindrical peripheral surface (16) the stamping roller (12) has a die (18) with a die relief structuring and the male die member (34) which is provided with a male die member relief structuring (48) negatively corresponding to the die relief structuring (20) is positioned on the cylindrical peripheral surface (16) of the backing roller (14) in accurate fitting relationship with the die (18) on the cylindrical peripheral surface (16) of the stamping roller (12), characterised in that a thin flexible bendable transfer male die member (24) having a fitting window (32) is temporarily fixed in accurately positioned relationship to the die (18) of the stamping roller (12), that the transfer male die member (24) is transferred from the stamping roller (12) to the backing roller (14) and fixed to the backing roller (14), wherein the stamping roller (12) and the backing roller (14) are driven in rotation in mutually opposite relationship at mutually corresponding peripheral speeds, and that then the male die member (34) is fixed in accurate fitting relationship in the fitting window (32) of the transfer male die member (24) fixed to the backing roller (14), wherein the male die member (34) provided with the male die member relief structuring (48) comprises a thin material which is stable in respect of shape and which has a cylindrical curvature (R) corresponding to the curvature (R) of the cylindrical peripheral surface of the backing roller (14).

2. A method as set forth in claim 1 characterised in that a transfer male die member (24) is used, which has a synthetic resin layer (28) on a base cloth (26), wherein the synthetic resin layer (28) on the base cloth (26) forms a frame (30) which definedly delimits the fitting window (32) for the male die member (34).

3. A method as set forth in claim 2 characterised in that a transfer male die member (24) is used, wherein the synthetic resin layer (28) is of a thickness (D) which corresponds to the thickness (D) of the male die member (34).

4. A method as set forth in claim 2 characterized in that a transfer male die member (24) is used, wherein the base cloth (26) is a glass or carbon fiber cloth and the synthetic resin layer (28) is an epoxy resin layer.

5. A method as set forth in claim 2 characterized in that the transfer male die member (24) is glued fast with its base cloth (26) to the cylindrical peripheral surface (40) of the backing roller (14).

6. A method as set forth in claim 1 characterized in that the male die member (34) is glued fast in the fitting window (32) of the transfer male die member (24).

* * * * *